US007324004B2

(12) United States Patent
Van Winkle et al.

(10) Patent No.: US 7,324,004 B2
(45) Date of Patent: Jan. 29, 2008

(54) CARGO SMOKE DETECTOR AND RELATED METHOD FOR REDUCING FALSE DETECTS

(75) Inventors: Wallace T. Van Winkle, Oro Valley, AZ (US); Lester J. Lowery, Tucson, AZ (US); Timothy L. Fujawa, Tucson, AZ (US); John Lohmeier, Tucson, AZ (US); Aileen K. McDowall, Tucson, AZ (US); Richard K. Morey, Tucson, AZ (US); Michael E. Patterson, Tucson, AZ (US); Andrew D. Bunn, Oro Valley, AZ (US); Maria M. Cornejo, Tucson, AZ (US)

(73) Assignee: Honeywell International, Inc., Morristown, NJ (US)

( * ) Notice: Subject to any disclaimer, the term of this patent is extended or adjusted under 35 U.S.C. 154(b) by 457 days.

(21) Appl. No.: 10/696,917

(22) Filed: Oct. 29, 2003

(65) Prior Publication Data

US 2005/0093707 A1 May 5, 2005

(51) Int. Cl.
*G08B 17/10* (2006.01)

(52) U.S. Cl. ..... 340/630; 340/660; 250/573; 250/574

(58) Field of Classification Search ..... 340/630; 250/573, 574
See application file for complete search history.

(56) References Cited

U.S. PATENT DOCUMENTS 4,254,414 A 3/1981 Street et al.
4,296,324 A 10/1981 Kern et al.
4,370,557 A 1/1983 Axmark et al.
4,401,978 A * 8/1983 Solomon ..... 340/628
4,414,542 A 11/1983 Farquhar et al.
4,490,715 A 12/1984 Kusanagi et al.
4,556,873 A 12/1985 Yamada et al.
4,640,628 A 2/1987 Seki et al.
4,647,786 A 3/1987 Güttinger et al.
4,763,115 A 8/1988 Cota
4,857,895 A * 8/1989 Kaprelian ..... 340/630
5,293,049 A 3/1994 Morey et al.
5,311,167 A 5/1994 Plimpton et al.
5,376,924 A 12/1994 Kubo et al.
5,592,147 A 1/1997 Wong
5,610,592 A * 3/1997 Okazaki ..... 340/628
5,694,208 A 12/1997 Ichikawa
5,767,776 A 6/1998 Wong (Continued)

OTHER PUBLICATIONS

PCT International Search Report PCT/US2004/035494.

*Primary Examiner*—Julie Bichngoc Lieu
(74) *Attorney, Agent, or Firm*—Ingrassia Fisher & Lorenz

(57) ABSTRACT

A method for reducing false detects may include emitting an infrared light beam from a primary emitter to a primary monitor detector, measuring a first voltage value using a primary receive detector and setting a primary smoke alarm flag corresponding to a primary channel if the first voltage value is above a first threshold value. The method may also include measuring a second voltage value using a secondary receive detector, setting a secondary smoke alarm flag corresponding to a secondary channel if the second voltage value is above a second threshold value and setting an alarm indicating a smoke condition if the primary smoke alarm flag and the secondary smoke alarm flag are set.

15 Claims, 4 Drawing Sheets

U.S. PATENT DOCUMENTS

| | | | | |
|---|---|---|---|---|
| 5,798,700 | A | 8/1998 | Wong | |
| 5,850,182 | A | 12/1998 | Schuler | |
| 5,923,260 | A | 7/1999 | Endo et al. | |
| 5,966,077 | A | 10/1999 | Wong | |
| 5,995,008 | A | 11/1999 | King et al. | |
| 6,081,195 | A | 6/2000 | Lynch | |
| 6,195,011 | B1 | 2/2001 | Winterble et al. | |
| 6,204,768 | B1 | 3/2001 | Kosugi et al. | |
| 6,208,252 | B1 | 3/2001 | Danilychev | |
| 6,326,897 | B2 * | 12/2001 | Kadwell et al. | 340/630 |
| 2002/0060632 | A1 | 5/2002 | Kadwell et al. | |

* cited by examiner

CARGO SMOKE DETECTOR AND RELATED METHOD FOR REDUCING FALSE DETECTS

BACKGROUND OF THE INVENTION

1. Field of the Invention

The present invention relates generally to aircraft smoke detectors, and more particularly to an aircraft smoke detector and related method for reducing false detects.

2. Description of the Related Art

Typically all commercial aircrafts have passenger and cargo compartments. To protect the passengers and cargo from fires, heat and smoke, detectors are generally installed in both the passenger and cargo compartments. These detectors send signals to a cockpit warning system to notify the pilot of any abnormal condition present in the passenger and cargo compartments. Receiving an accurate and immediate emergency signal from the detectors is critical because it may allow the pilot and staff to either extinguish the fire while the aircraft is in flight or make an emergency landing to evacuate the passengers and crew.

Detectors are generally classified into one of three categories: flame detectors; thermal detectors; and smoke detectors. These three classes of detectors correspond to the three primary properties of a fire, which are flame, heat and smoke. One type of smoke detector includes a radiation source, a control circuit for intermittently driving the radiation source and a radiation receiver. The radiation receiver is connected to an evaluation circuit capable of outputting a smoke alarm signal when the radiation receiver receives radiation influenced by smoke particles in synchronization with operation of the radiation source.

One drawback of these types of smoke detectors is the large number of false alarms caused by conditions such as malfunctioning smoke detectors or dust and fiber particles contaminating the smoke detectors. For example, the passenger and cargo compartments of an aircraft may be filled with dust and fiber particles resulting from blankets, magazines, food, luggage as well as other items that may attach to the radiation source. In many situations, the radiation receiver receives the dust and fiber particles but incorrectly interprets them as smoke particles and activates the smoke alarm signal resulting in the pilot having to take costly and unnecessary actions such as an emergency landing of the aircraft. Some companies have attempted to develop filters to try to filter out the dust and fiber particles, however, these attempts have been largely unsuccessful.

Thus, it should be appreciated that there is a need for an aircraft smoke detector and related method for reducing false detects. The present invention fulfills this need as well as others.

SUMMARY OF THE INVENTION

The invention relates to a method for reducing false detects. In particular, and by way of example only, one embodiment of the invention is a method including emitting an infrared light beam from a primary emitter to a primary monitor detector, measuring a first voltage value using a primary receive detector and setting a primary smoke alarm flag corresponding to a primary channel if the first voltage value is above a first threshold value. The method may also include measuring a second voltage value using a secondary receive detector, setting a secondary smoke alarm flag corresponding to a secondary channel if the second voltage value is above a second threshold value and setting an alarm indicating a smoke condition if the primary smoke alarm flag and the secondary smoke alarm flag are set.

One embodiment of the invention is a method for reducing false detects using an aircraft smoke detection system capable of simultaneously operating a primary channel and a secondary channel. The method may include transmitting light from a first emitter to a first monitor detector, receiving a portion of the light using a first receive detector and determining a primary voltage by measuring the portion of the light received from the first receive detector and if the primary voltage is greater than a primary threshold value, then setting a smoke alarm flag for the primary channel. The method may also include receiving a portion of the light using a second receive detector, determining a secondary voltage by measuring the portion of the light received from the second receive detector and if the secondary voltage is greater than a secondary threshold value, then setting a smoke alarm flag for the secondary channel, and transmitting an alarm signal when the smoke alarm flag for the primary channel and the smoke alarm flag for the secondary channel are set.

One embodiment of the invention is an aircraft smoke detection system including a central processing unit and a smoke detector unit for receiving control signals from the central processing unit. The smoke detection unit may include a chamber having an inlet for allowing air and smoke to enter the chamber, a first emitter, positioned in the chamber, for emitting light along a path, a first monitor detector, positioned along the path of the emitted light, for receiving the emitted light from the first emitter and a first receive detector, positioned off the path of the emitted light, for receiving a portion of the emitted light when smoke passes between the first emitter and the first monitor detector causing the emitted light to scatter and for transmitting a first smoke alarm signal to the central processing unit.

These and other features and advantages of the embodiments of the invention will become apparent from the following detailed description, taken in conjunction with the accompanying drawings, which illustrate, by way of example the principles of the invention.

DETAILED DESCRIPTION OF THE PRESENTLY PREFERRED EMBODIMENTS

Devices and methods that implement the embodiments of the various features of the invention will now be described with reference to the drawings. The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" in various places in the specification are not necessarily all referring to the same embodiment. Throughout the drawings, reference numbers are re-used to indicate correspondence between referenced elements. In addition, the first digit of each reference number indicates the figure in which the element first appears.

Figure 1:
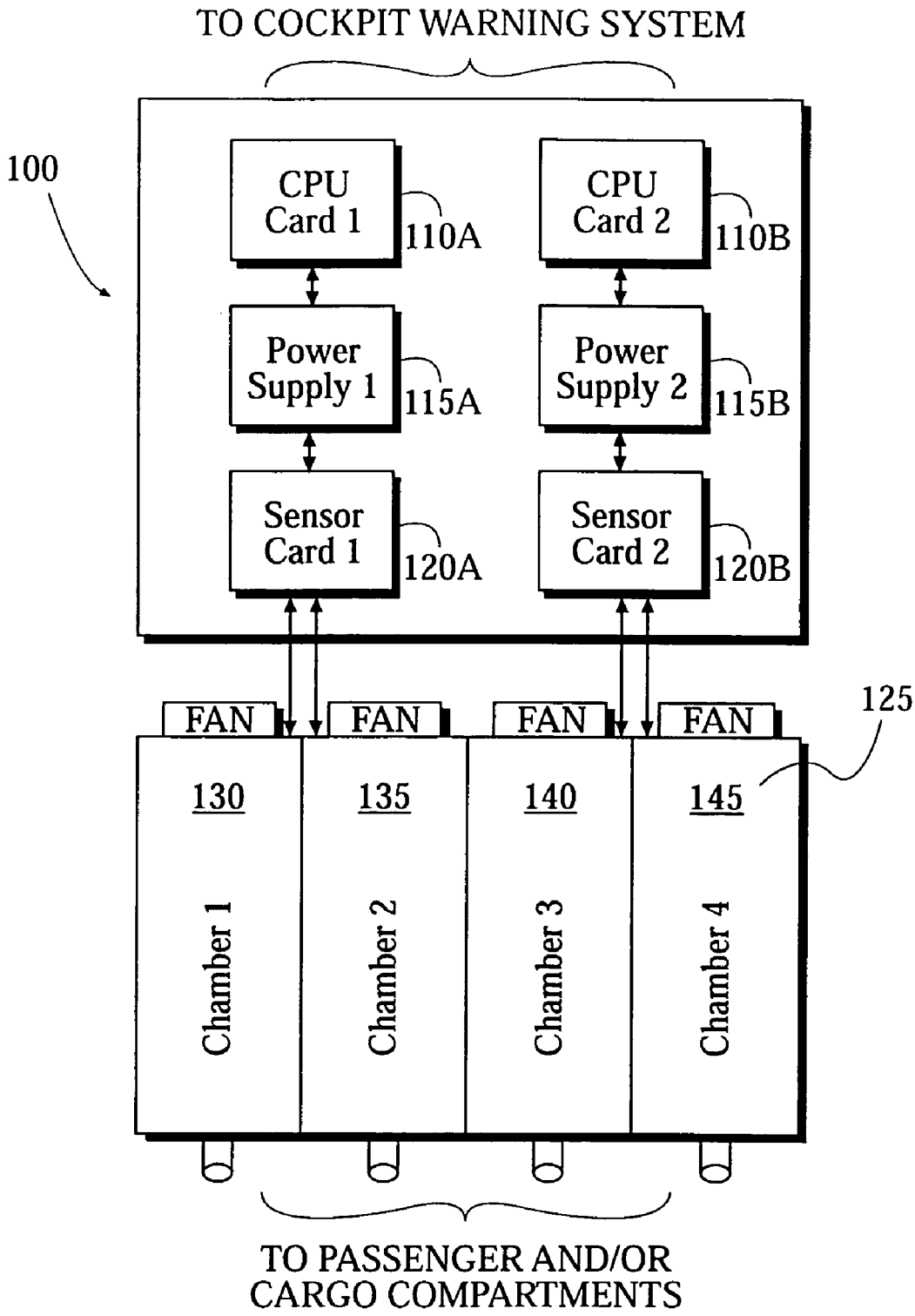
FIG. 1 is a block diagram of an aircraft smoke detecting system according to an embodiment of the invention.

Referring now more particularly to the drawings, FIG. 1 is a block diagram of an aircraft smoke detection system 100 that is used to detect smoke within the passenger and cargo compartments (the cargo compartment may include a forward cargo bay and an aft cargo bay) of an aircraft. The aircraft smoke detection system 100 may include two central processing unit (CPU) cards 110*a*, 110*b*, two power supplies 115*a*, 115*b*, two sensor cards 120*a*, 120*b* and a smoke detector unit 125. In one embodiment, the two CPU cards 110*a*, 110*b* are electrically connected to the two power supplies 115*a*, 115*b*. The CPU cards 110*a*, 110*b* control the operations of the sensor cards 120*a*, 120*b* and the smoke detector unit 125. Each CPU card 110*a*, 110*b* may include a processor and an associated memory. Although the CPU cards 110*a*, 110*b* are illustrated in FIG. 1 as a separate hardware component, hardware and/or software may be used to implement the functions and operations of the CPU cards 110*a*, 110*b*. For example, computer software instructions can be stored in the memory and processed by the processor. Thus, references to the CPU cards 110*a*, 110*b* are intended to mean hardware components, computer programs stored in the memory and processed by the processors or a combination of hardware and software.

The power supplies 115*a*, 115*b* power the two CPU cards 110*a*, 110*b*, the two sensor cards 120*a*, 120*b* and the smoke detector unit 125. The two sensor cards 120*a*, 120*b* are used to condition the electrical outputs of chambers 130, 135, 140 and 145. The smoke detector unit 125 may include one or more chambers, and for example, may include four similarly configured chambers 130, 135, 140, 145 as shown in FIG. 1. For purposes of this disclosure and by way of example only, since each chamber has identical components and configuration, the smoke detector unit 125 will be described as having one chamber 130. One or more smoke detector units 125 may be positioned in the forward cargo bay of an aircraft and one or more smoke detector units 125 may be positioned in the aft cargo bay of an aircraft.

Figure 2:
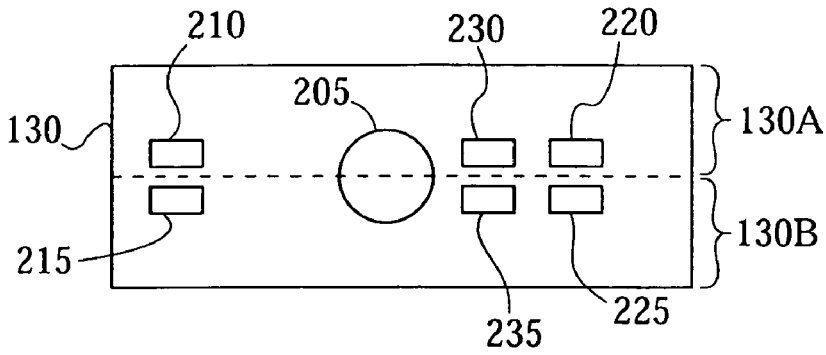
FIG. 2 is a front view of the chamber of the smoke detector unit where the front cover of the chamber has been removed so that the components within the chamber can be viewed according to an embodiment of the invention.

FIG. 2 is a front view of the chamber 130 of the smoke detector unit 125 where the front cover of the chamber 130 has been removed so that the components within the chamber 130 can be viewed. The chamber 130 includes a top portion 130*a* and a bottom portion 130*b*. The bottom portion 130*b* includes the same components as those in the top portion 130*a*. When looking at a top view of the chamber 103, the components located in the bottom portion 130*b* are positioned directly below the components located in the top portion 130*a*. The components located in the top portion 130*a* generally form channel one (or the primary channel) and the components located in the bottom portion 130*b* generally form channel two (or the secondary channel). The CPU 110 controls the operations of both channels and uses both channels to identify or detect and confirm the presence of smoke. The secondary channel increases the redundancy of the aircraft smoke detection system 100 through the use of the secondary channel components being positioned near or adjacent to the primary channel components.

The smoke detector unit 125 may include an inlet 205 for allowing air and smoke to enter the chamber 130, first and second emitters 210, 215 for transmitting infrared light within the chamber 130, first and second monitor detectors 220, 225 for receiving and monitoring (e.g., measuring) the transmitted light and first and second receive detectors 230, 235 for receiving and monitoring scattered light. In one embodiment, channel one may include the first emitter 210, the first monitor detector 220 and the first receive detector 230, and channel two may include the second emitter 215, the second monitor detector 225 and the second receive detector 235.

Figure 3:
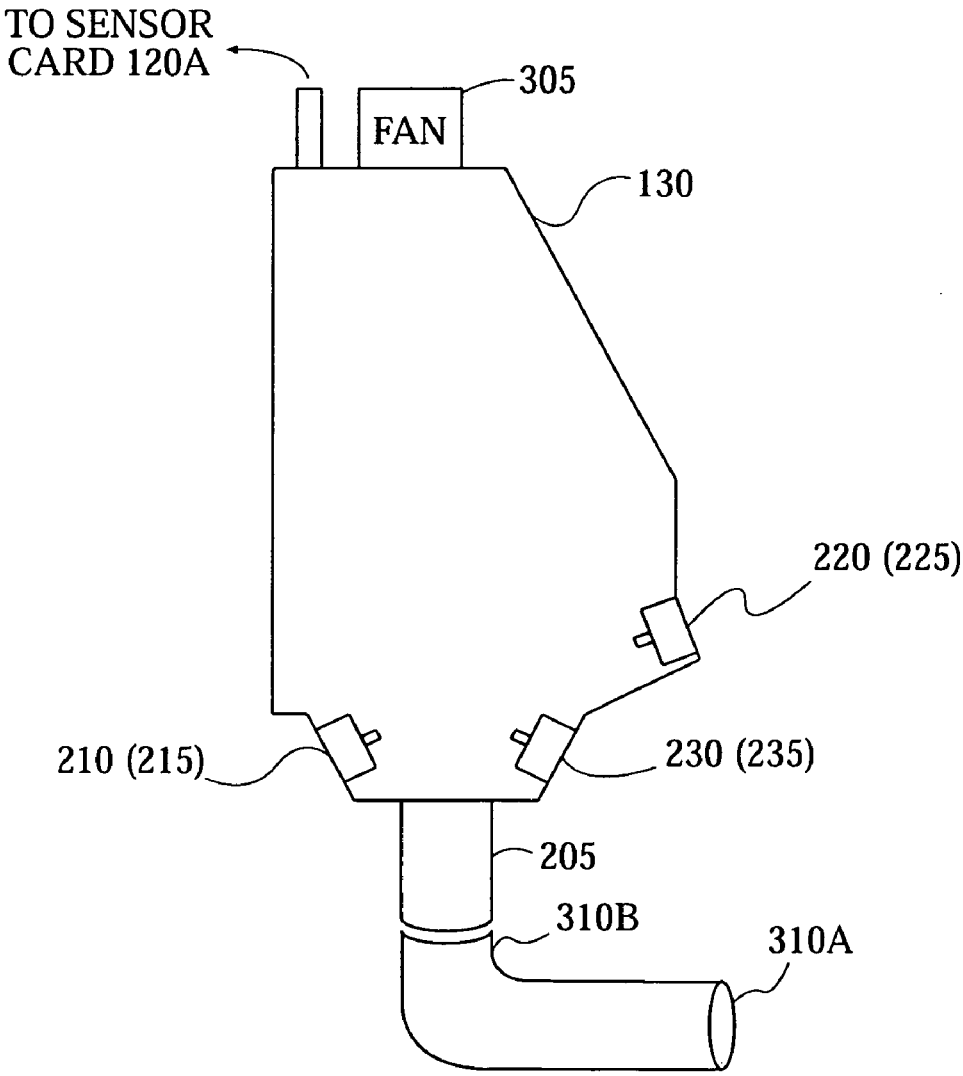
FIG. 3 is a top view of the chamber of the smoke detector unit where the top cover of the chamber has been removed so that the components within the chamber can be viewed according to an embodiment of the invention.

FIG. 3 is a top view of the chamber 130 of the smoke detector unit 125 where the top cover of the chamber 130 has been removed so that the components within the chamber 130 can be viewed. The smoke detector unit 125 may include a fan 305 that moves (e.g., pulls) the air and smoke received from the inlet 205 through the chamber 130 and out of the chamber 130. The smoke detector unit 125 may also include a tube 310 having an input end 310*a* and an output end 310*b* connected to the inlet 205. The input end 310*a* of the tube 310 may be positioned throughout the inside of the aircraft, for example, at the ceiling of the passenger and cargo compartments of the aircraft. When smoke is present in the passenger or cargo compartment, the smoke generally travels through the compartment and into the input end 310*a* of the tube 310, through the tube 310 and into the chamber 130. The fan 305 provides the suction to pull the air and smoke through the tube 310 and into the chamber 130.

Figure 4A:
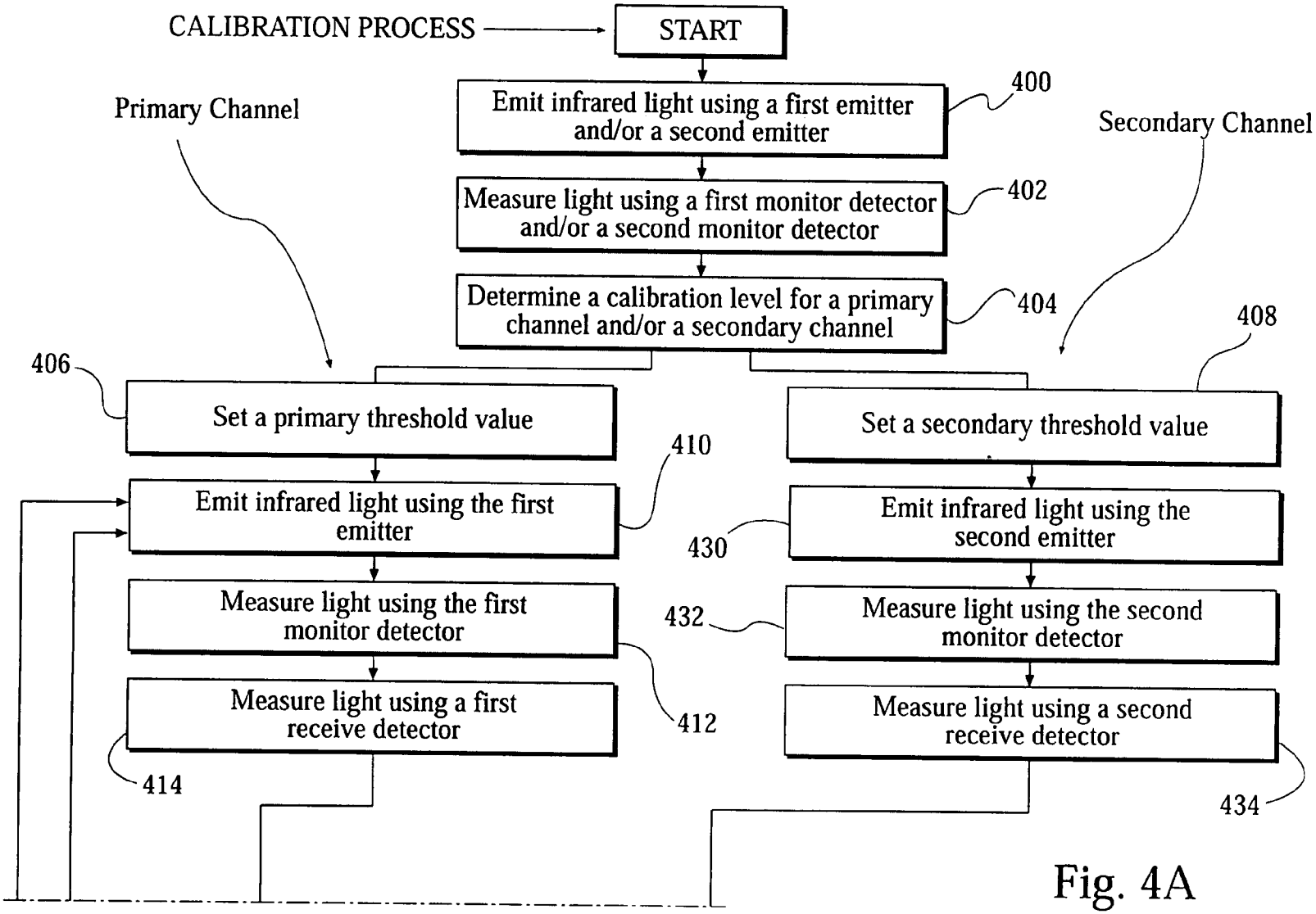
FIG. 4 is a flow chart illustrating the method of reducing false detects using the aircraft smoke detection system of FIG. 1.
Figure 4B:
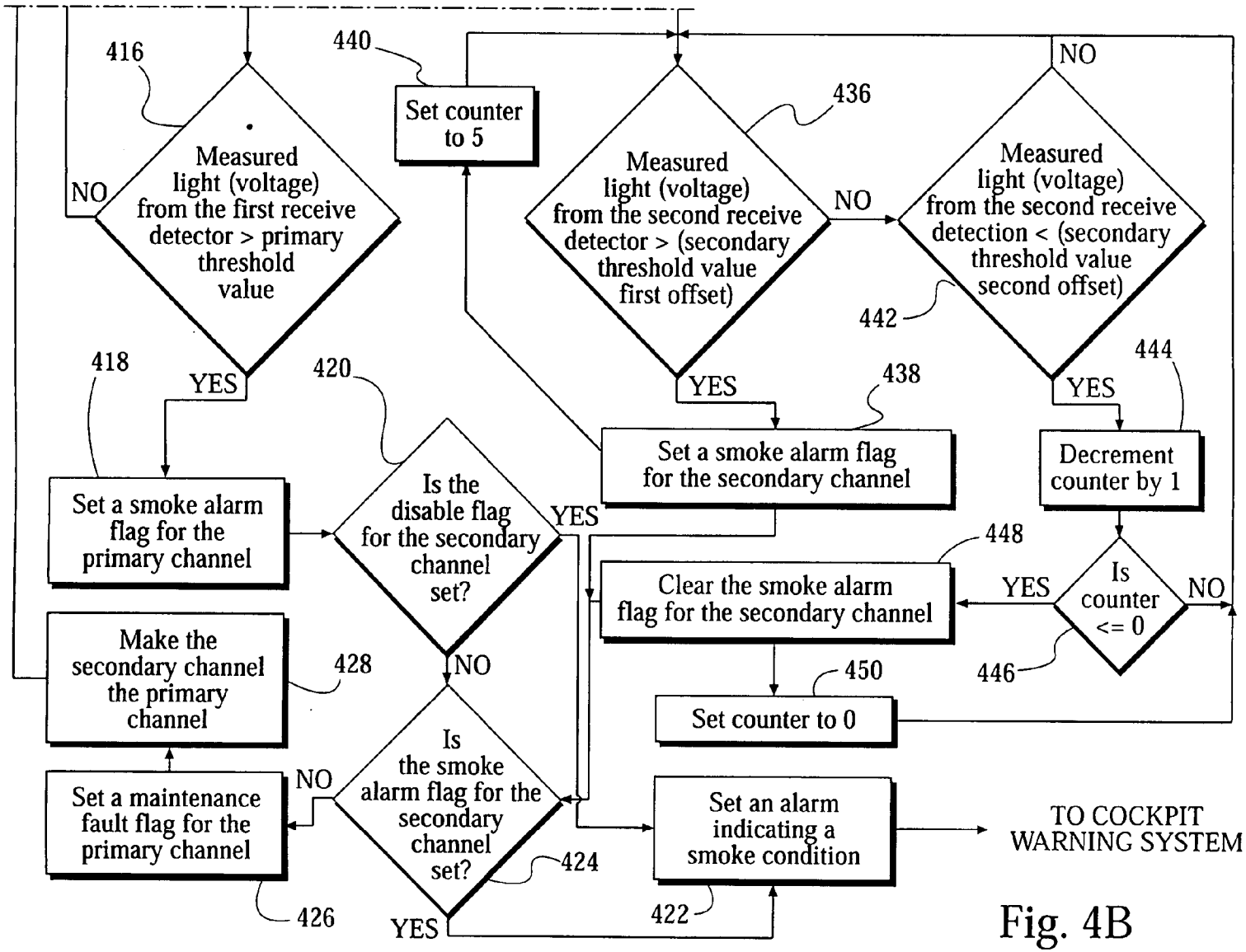

FIG. 4 is a flow chart illustrating a method for reducing false detects using the aircraft smoke detection system 100 of FIG. 1. The CPU card 110 maintains a counter, a disable flag, a smoke alarm flag and a maintenance fault flag for the primary and secondary channels that are all initially cleared. The CPU card 110 transmits a pulse signal to the second emitter 215, which emits an infrared light beam to the second monitor detector 225 (400) and monitors the light reading (i.e., voltage) measured by the second monitor detector 225 (402). The CPU card 110 determines a calibration level, which represents the scatter count of the air in the chamber 130 in the absence of any smoke, by measuring the voltage received by the second monitor detector 225 (404). The scatter count represents the amount of infrared light (e.g., measured in terms of voltage) detected by the second monitor detector 225. Generally, a linear relationship exists between the scatter count and the measured voltage. That is, the greater the scatter count, the greater the measured voltage, and vice versa. The CPU card 110 may also determine a calibration level for the primary channel in a similar manner. The calibration level for each channel may be substantially similar.

The CPU card 110 can set a primary threshold value (406) and a secondary threshold value (408) to any value between about 3.6 volts and about 7.2 volts. The threshold value may represent the scatter count or the voltage value at which the percentage smoke has reached a point that indicates a smoke or fire condition. The CPU card 110 transmits a pulse signal to the first emitter 210, which emits an infrared light beam to the first monitor detector 220 (410), and monitors the light reading (i.e., voltage) measured by the first monitor detector 220 (412). The first monitor detector 220 transmits the measured voltage to the CPU card 110 and the CPU card 110 may adjust the pulse signal being output by the first emitter 210. The first monitor detector 220 provides feedback to CPU card 110 to ensure that the first emitter 210 is emitting a substantially constant infrared light beam. In one embodiment, the first emitter 210 periodically emits infrared light and the first monitor detector 220 periodically measures the voltage of the infrared light.

During a smoke condition, the smoke enters the inlet 205 and travels between the first emitter 210 and the first monitor detector 220. The smoke causes the infrared light beam from the first emitter 210 to scatter or diffuse so that some of the scattered or diffused light is detected by the first receive detector 230 (414). The CPU card 110 periodically measures the voltage received from the first receive detector 230 and if the measured voltage is greater than the primary threshold value (e.g., 7.2 volts) (416), then the CPU card 110 sets a smoke alarm flag for the primary channel (418). In one embodiment, if 1 percent smoke is present in the chamber 130, then the measured voltage is about 3.6 volts, if 2 percent smoke is present in the chamber 130, then the measured voltage is about 5.4 volts and if 3 percent smoke is present in the chamber 130, then the measured voltage is about 7.2 volts.

Once the smoke alarm flag is set on the primary channel, the CPU card 110 determines if the secondary channel is operational by checking the status of its disable flag (420). If the secondary channel is not functioning properly, the CPU card 110 sets the disable flag for the secondary channel. If the disable flag is set, then the secondary channel is non-functional and the CPU card 110 sets an alarm indicating a smoke condition (422). If the disable flag is clear, then the CPU card 110 checks the smoke alarm flag for the secondary channel (424). If the smoke alarm flag is set, then the CPU card 110 sets an alarm indicating a smoke condition (422). If the smoke alarm flag is clear, then the CPU card 110 sets a maintenance fault flag for the primary channel indicating that the primary channel is non-functional (426) and makes the secondary channel the primary channel (428).

The operations of the secondary channel are being performed simultaneously with the operations of the primary channel. The secondary channel confirms or rejects the alarm of the primary channel. Therefore, the CPU card 110 transmits a pulse signal to the second emitter 215, which emits an infrared light beam to the second monitor detector 225 (430), and monitors the light reading (i.e., voltage) measured by the second monitor detector 225 (432). The second monitor detector 225 transmits the measured voltage to the CPU card 110 and the CPU card 110 may adjust the pulse signal in response. The second monitor detector 225 provides feedback to the second emitter 215 to ensure that the second emitter 215 is emitting a substantially constant infrared light beam. In one embodiment, the second emitter 215 periodically emits infrared light and the second monitor detector 225 periodically measures the voltage (e.g., counts) of the infrared light.

During a smoke condition, the smoke enters the inlet 205 and travels between the second emitter 215 and the second monitor detector 225. The smoke causes the infrared light beam from the second emitter 215 to scatter or diffuse so that some of the scattered or diffused light is detected by the second receive detector 235 (434). The CPU card 110 periodically measures the voltage received from the second receive detector 235 and if the measured voltage is greater than the secondary threshold value plus a first offset (436), then the CPU card 110 sets a smoke alarm flag for the secondary channel (438) and sets the counter to 5 (440). Incrementing the counter by 5 counts and decrementing it by one count ensures that the smoke alarm flag for the secondary channel is valid for at least a minimum of two (2) minutes. In one embodiment, the first offset can be about 90 counts. If the measured value is less than the secondary threshold value plus a second offset (442), then the CPU card 110 decrements the counter by 1 (444) and determines whether the counter is less than or equal to 0 (446). In one embodiment, the second offset can be about 60 counts. If the counter is less than or equal to 0, then the CPU card 110 clears the smoke alarm flag for the secondary channel (448) and sets the counter to 0 (450).

Although an exemplary embodiment of the invention has been shown and described, many other changes, combinations, omissions, modifications and substitutions, in addition to those set forth in the above paragraphs, may be made by one having skill in the art without necessarily departing from the spirit and scope of this invention. Accordingly, the present invention is not intended to be limited by the preferred embodiments, but is to be defined by reference to the appended claims.

What is claimed is:

1. A method for reducing false detects, comprising:

emitting an infrared light beam from a primary emitter through at least one of air and smoke to a primary monitor detector;

detecting a first portion of the infrared light beam scattered byte at least one of the air and smoke with a primary receive detector;

measuring a first voltage value associated with the first portion of the infrared light beam using the primary receive detector, setting a primary smoke alarm flag corresponding to a primary channel if the first voltage value is above a first threshold value;

detecting a second portion of the infrared light beam scattered by the at least one of air and smoke with a secondary receive detector, the secondary receive detector being associated with a secondary emitter and a secondary monitor detector;

measuring a second voltage value associated with the second portion of the infrared light beam using the secondary receive detector;

setting a secondary smoke alarm flag corresponding to a secondary channel if the second voltage value is above a second threshold value; and setting an alarm indicating a smoke condition if the primary smoke alarm flag and the secondary smoke alarm flag are set.

2. The method as defined in claim 1, wherein the secondaty receive detector is directed at a line interconnecting the secondary emitter and the secondary monitor detector.

3. The method as defined in claim 2, further comprising determining a calibration level for the primary channel representing a scatter count of the air and wherein the first threshold value is equal to the calibration level for the primary channel plus a smoke count value that is equal to a three percent smoke value of the air.

4. The method as defined in claim 1, further comprising determining a calibration level for the secondary channel representing a scatter count of the air.

5. The method as defined in claim 4, wherein the second threshold value is equal to the calibration level for the secondary channel plus a smoke count value that is equal to a three percent smoke value of the air.

6. The method as defined in claim 1, further comprising setting a disable flag corresponding to the secondary channel if the secondary monitor detector is not capable of receiving the infrared light beam from the secondary emitter.

7. The method as defined in claim 1, further comprising setting a disable flag corresponding to the primary channel if the primary monitor detector is not dapable of receiving the infrared light beam from the primary emitter.

8. The method as defined in claim 7, further comprising setting a maintenance fault flag for the primary channel if the disable flag for the primary channel is set.

9. The method as defined in claim 8, further comprising switching the secondary channel to the primary channel if the maintenance fault flag for the primary channel is set.

10. The method as defined in claim 1, wherein the first threshold value is equal to the second threshold value.

11. A method for reducing false detects using an aircraft smoke detection system capable of simultaneously operating a primary channel and a secondary channel, the method comprising:

transmitting light from a first emitter through at least one of air and smoke to a first monitor detector;

receiving a first portion of the light using a first receive detector, the first portion of the light having been scattered by the at least one of air and smoke;

determining a primary voltage by measuring te first portion of the light received from the first receive detector and if the primary voltage is greater than a primary threshold value, ten setting a smoke alarm flag for the primary channel;

receiving a second portion of the light using a second receive detector, the second portion of the light having been scattered by the at least one of the air and smoke, the second receive detector being directed at a line intersecting a second emitter and a second monitor detector;

determining a secondary voltage by measuring the second portion of the light received from the second receive detector and if the secondary voltage is greater than a secondary threshold value, then setting a smoke alann flag for the secondary channel; and transmitting an alarm signal when the smoke alarm flag for the primary channel and the smoke alarm flag for the secondary channel are set.

12. The method as defined in claim 11, further comprising transmitting light from the second emitter to the second monitor detector.

13. The method as defined in claim 11, wherein the primary threshold value is greater than or equal to a one percent smoke value.

14. The method as defined in claim 11, wherein the secondary threshold value is greater than or equal to a one percent smoke value.

15. The method as defined in claim 11, further comprising:

setting a maintenance fault flag for the primary channel if the first monitor detector is not capable of receiving the light from the first emitter; and switching the secondary channel to the primary channel if the maintenance fault flag for the primary channel is set.

* * * * *

UNITED STATES PATENT AND TRADEMARK OFFICE

CERTIFICATE OF CORRECTION

PATENT NO. : 7,324,004 B2
APPLICATION NO. : 10/696917
DATED : January 29, 2008
INVENTOR(S) : Wallace T. Van Winkle et al.

It is certified that error appears in the above-identified patent and that said Letters Patent is hereby corrected as shown below:

Column 6, line 66, “dapable” should be changed to --capable--;
Column 7, line 18, “te” should be changed to --the--;
Column 7, line 21, “ten” should be changed to --then--;
Column 8, line 4, “alann” should be changed to --alarm--.

Signed and Sealed this

Twenty-ninth Day of July, 2008

JON W. DUDAS
*Director of the United States Patent and Trademark Office*